US005116264A

United States Patent [19]

Wiederrich et al.

[11] Patent Number: 5,116,264

[45] Date of Patent: May 26, 1992

[54] POSITIONABLE SERVICE BENCH

[76] Inventors: LeRoy J. Wiederrich, Box 509; Robert G. Butler, 1045 Lincoln Ave., both of Havre, Mont. 59501

[21] Appl. No.: 645,033

[22] Filed: Jan. 22, 1991

[51] Int. Cl.[5] ..... B66B 9/20

[52] U.S. Cl. ..... 187/11; 187/8.41; 269/17; 414/608

[58] Field of Search ..... 187/8.41, 8.43, 9 R, 187/11, 21, 27, 8.59; 254/2 R, 2 B; 269/17, 16, 15; 414/608; 248/906

[56] References Cited

U.S. PATENT DOCUMENTS

| | | | |
|---|---|---|---|
| 1,051,247 | 1/1913 | McLendon | 187/11 X |
| 1,344,272 | 6/1920 | Hescock | 187/11 |
| 1,408,522 | 3/1922 | Laue | 187/11 |
| 1,789,025 | 1/1931 | Shepard | 187/11 |
| 2,080,304 | 5/1937 | Cochran | 187/11 |
| 2,156,204 | 4/1939 | Stolze | 187/9 R X |
| 2,854,673 | 10/1958 | Ramsey | 187/9 R X |
| 3,084,764 | 4/1963 | Duffey et al. | 187/8.41 |
| 3,385,401 | 5/1968 | Campbell et al. | 187/11 |
| 3,673,310 | 6/1972 | Welsh | 248/906 X |
| 4,122,956 | 10/1978 | Hargrove | 269/16 X |
| 4,421,209 | 12/1983 | Vermette et al. | 187/9 R |
| 4,987,976 | 1/1991 | Daugherty | 187/9 R X |

OTHER PUBLICATIONS

MTM Materials Storage Co. Catalog, Springfield, VA, pp. 90, 91, 92, 93, 94, 95.

Global Industrial Equipment, Catalog #92F, pp. 48, 49, 50.

C & H Ind., Inc. Winter Catalog 901, pp. 153, 157, 158, 159, 160, 161.

Rand Material Handling Co., Inc., Catalog 90-2, pp. 80, 81, 82.

Tools & Supplies for Industry, Catalog #882, pp. 143, 150.

*Primary Examiner*—Joseph E. Valenza
*Assistant Examiner*—Dean A. Reichard

[57] ABSTRACT

A mobile positionable service bench 20 comprising of a square U-configured base 22 and a vertical mast structure 56 mounted upright on a square U-configured base 22. A winch 68 mounted on vertical mast structure 56 and a cable 66 connected thereto and to the elevator assembly 75 is operable to raise and lower tool tray 105. Elevator assembly 75 is equipped with dollies 78*a*, 79*a*, 80*a* and 81*a* to maintain alignment and facilitate travel and load carrying capabilities. Tray support arms 97 will pivotally mount to elevator assembly 75 and provide lateral positioning capabilities of tool tray 105. Light bracket 121 on tool tray 105 will accept the stem base of light fixture 123 to illuminate the work area. Air chucks 161*a*, 161*b*, 161*c* and 161*d* and electric outlet box 152*a*, 152*b*, 152 c, and 152*d* provide outlets for either pneumatic or electrical tools. Safety brake yoke 76 and safety brake arms 86 and 87 provide a fail-safe mechanism to guard against the sudden drop of elevator assembly 75 due to the sudden failure of cable 66.

13 Claims, 12 Drawing Sheets

POSITIONABLE SERVICE BENCH

FIELD OF INVENTION

This invention relates generally to a service bench utilized for equipment repair and maintenance, and relates specifically to an adjustable height, easily positionable, service bench provided with an adjustable tool support tray and other accessories that may be positioned within arms reach of a mechanic working on mobile or stationary equipment.

BACKGROUND OF THE INVENTION

Presently, mechanics and technicians are limited to basic and outdated devices for positioning and supporting tools and test equipment while performing maintenance and repair on mobile and stationary equipment. The need for a work bench at the specific job location is presently dependent upon the familiar roll-away tool box, however the weight of these tool boxes, when containing all tools normally stored therein, is such that they cannot be easily moved from one location to another effectively or safely. To overcome the weight factor, small lightweight maintenance carts have been utilized by some mechanics. Each of these devices can only be moved as close to the work site as the first obstruction, such as a wheel or bumper, and neither has provisions for height adjustment.

Another, and less desirable alternative is to place tools and/or parts on some portion of the equipment or machine being worked on. This can result in tools or parts falling to the floor or possibly into the equipment or mechanism being worked on, thereby creating a safety hazard that could result in serious damage to the equipment or injury to the mechanic or maintenance person.

In each of these prior art techniques, the awkward or remote location of the tools and parts relative to the mechanic or maintenance person results in time-consuming reaching, turning, and wasted steps leading to increased operator fatigue and decreased efficiency, particularly when the mechanic is working several feet off the floor on certain types of equipment.

Other outdated prior art devices such as mobile storage carts, roll-around maintenance carts, and roll-around tool storage chests are extremely limited in function. In all known cases these devices will transport tools and equipment to the job location but only in a fixed position, configuration and height.

Self-elevating lift tables and hydraulic lift tables designed to lift objects and equipment to various but very limited heights for maintenance or loading are known but are not designed or intended to function in the capacity of a positionable service bench, as is the present invention. No prior art system is known that incorporates the versatility of the positionable service bench of the present invention.

Accordingly, it is an object of the present invention to provide a new and novel positionable service bench that saves time and provides more efficient work possibilities for a mechanic or technician.

Another object of the present invention is to provide a positionable service bench having a height and laterally adjustable tool and test equipment tray and work illumination device.

It is another object of the present invention to provide a positionable service bench having a tool supporting surface that is positionable within the reach of a mechanic working on mobile or stationary equipment.

Another object of the present invention is to provide an adjustable height and laterally positionable small parts organizer and removable storage compartments on a positionable service bench.

A further object of the present invention is to provide a positionable service bench having a work illumination light, utility air and electrical outlets and service manual support rack disposed within the reach of a mechanic working on mobile or stationary equipment.

Another object of the present invention is a lightweight, easily movable service bench for positioning tools and test equipment readily accessible to the user when working on mobile and stationary equipment.

An additional object of the present invention is to provide a positionable service bench that is light in weight, simple in structure, easy to dismantle and assemble and versatile in use.

Another object of the present invention is a positionable service bench that maintains the necessary tools for a specific job within reach of the user to thereby increase productivity and reduce user fatigue by eliminating repetitious trips to obtain and replace different tools.

SUMMARY OF THE INVENTION

According to the present invention, the foregoing and additional objects are attained by providing a positionable service bench having a square U-shaped horizontal base provided with a wheel disposed at the end of each leg of the open U-shaped base and a retractable caster wheel disposed in the center of the closed end. A rest pad is attached to each end of the closed end of the horizontal base and, along with the wheels at each end of the open base, serves to support the service bench on a floor, deck, or other support surface, when the caster wheel is in the retracted position. A handle connected to suitable retracting and extending mechanism is employed to extend and retract the caster wheel and to assist in moving the positionable service bench when the retractable caster wheel is in the extended position. When extended, the caster wheel contacts the support surface and lifts the closed end of the U-shaped base adequately to remove the rest pads from contact therewith.

A vertical mast, formed of two spaced columns each removably attached at one end of the horizontal base and provided with an integral cross bar at the opposite ends thereof, serves as a support for an elevator structure. The elevator structure includes a winch or windlass having a hand crank and receiving a cable suspended from a pulley or cable sheave rotatably supported by the cross bar of the vertical mast. Also secured to and movable with the elevator structure is a laterally adjustable tray support structure for a horizontal tool tray. The tray support structure is pivotally connected at one end to the elevator structure and releasably attached to the horizontal tray at the other end thereof to permit pivotal and horizontal movement of the tool tray relative to the vertical mast. The tool tray is provided with a planar surface for supporting various tools with accessory receiving brackets attached to sides thereof for receiving a service manual support and a trouble light fixture. Also releasably attached to the tool tray is a plurality of individual small parts organizer and storage containers or compartments. An air manifold leading to a plurality of air chucks and a plurality of electrical outlets connectable to a common source of electricity are also provided on the vertical mast of the positionable service bench.

BRIEF DESCRIPTION OF THE DRAWINGS

A more complete appreciation of the invention and many of the attendant advantages thereof will be more readily apparent as the same becomes better understood by reference to the following detailed description when considered in reference to the accompanying drawings wherein.

DETAILED DESCRIPTION

Figure 1:
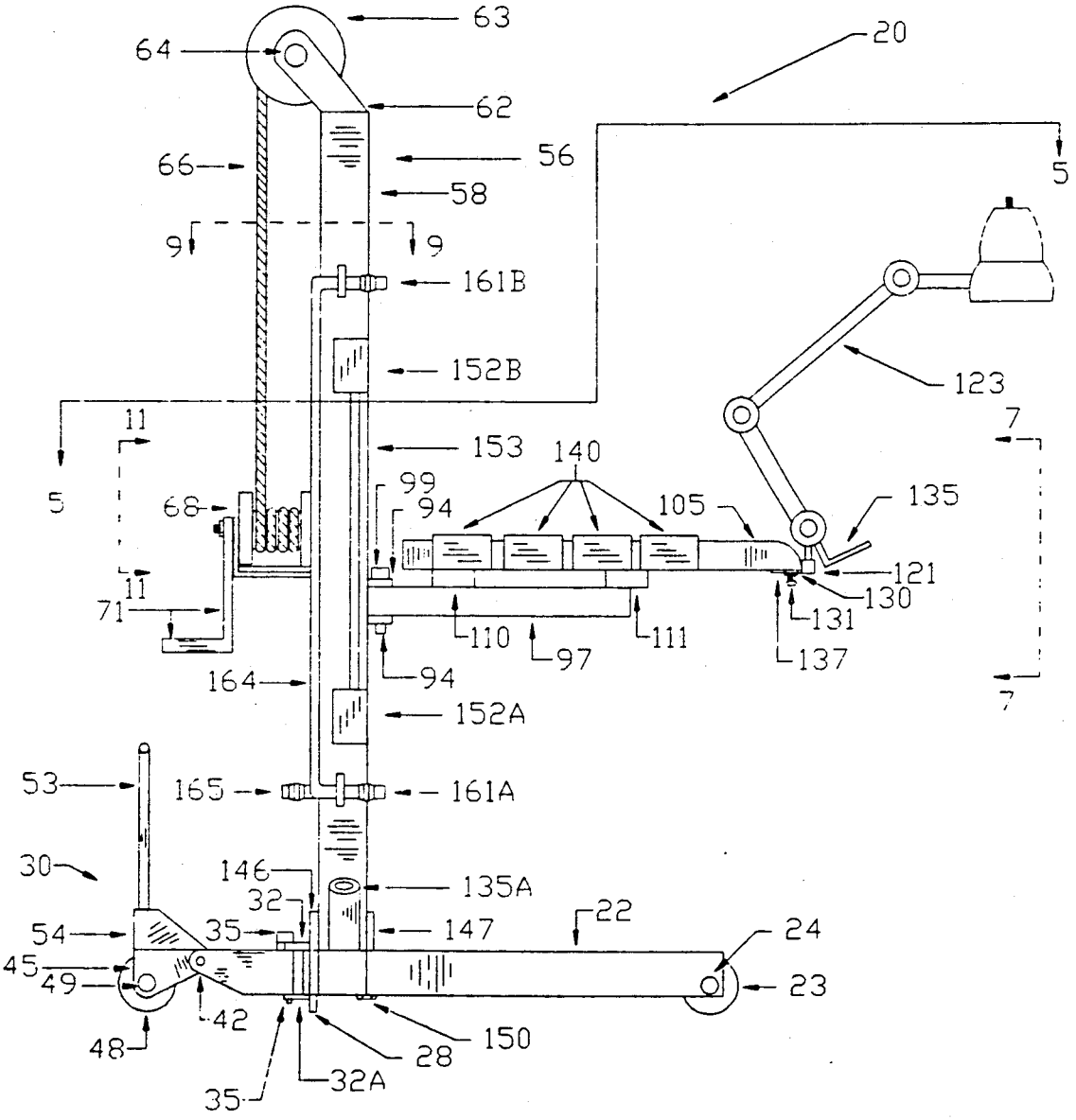
FIG. 1 is a side elevation of the positionable service bench according to the present invention.

Referring now to the drawings, and more particularly to FIG. 1-4, the preferred embodiment of the positionable service bench of the present invention is shown and designated generally by reference numeral 20. Positionable service bench 20 is provided with a square U-configured horizontal base 22 having a wheel disposed at the end of each leg of the open U-shaped base and as designated by reference numerals 23, 25. Wheels 23, 25 serve as the front wheels for positionable service bench 20 and are rotatably supported by respective conventional axles 24, 26 extending through the respective hollow ends of base 22. A fixed rest pad is attached to each end of the closed end of the horizontal base 22, as designated by reference numerals 28, 29. Rest pads 28 and 29, along with wheels 23 and 25, serve to support service bench 20 in fixed position on a support surface when support service bench 20 is in a stationary or use position.

A retractable caster wheel assembly 30 is disposed at the aft or rear of horizontal base 22 and is secured thereto by caster swivel acceptor, plates 32 and **32*a*. As shown more clearly in FIG. 6, caster swivel acceptor plates 32, 32*a* are welded, or otherwise conventionally attached, at the intermediate length of the top and bottom horizontal plane surfaces of the cross member of the U-shaped base 22. A caster swivel 34 is spaced from base 22 and pivotally connected to the ends of caster swivel acceptor plates 32, 32*a* via caster swivel pin 35. Swivel pin 35 is positioned through aligned holes 36, 36*a* provided through caster swivel acceptor plates 32, 32*a* and through a smooth vertical bore 37 provided in the circular end of caster swivel 34**.

Figure 6:
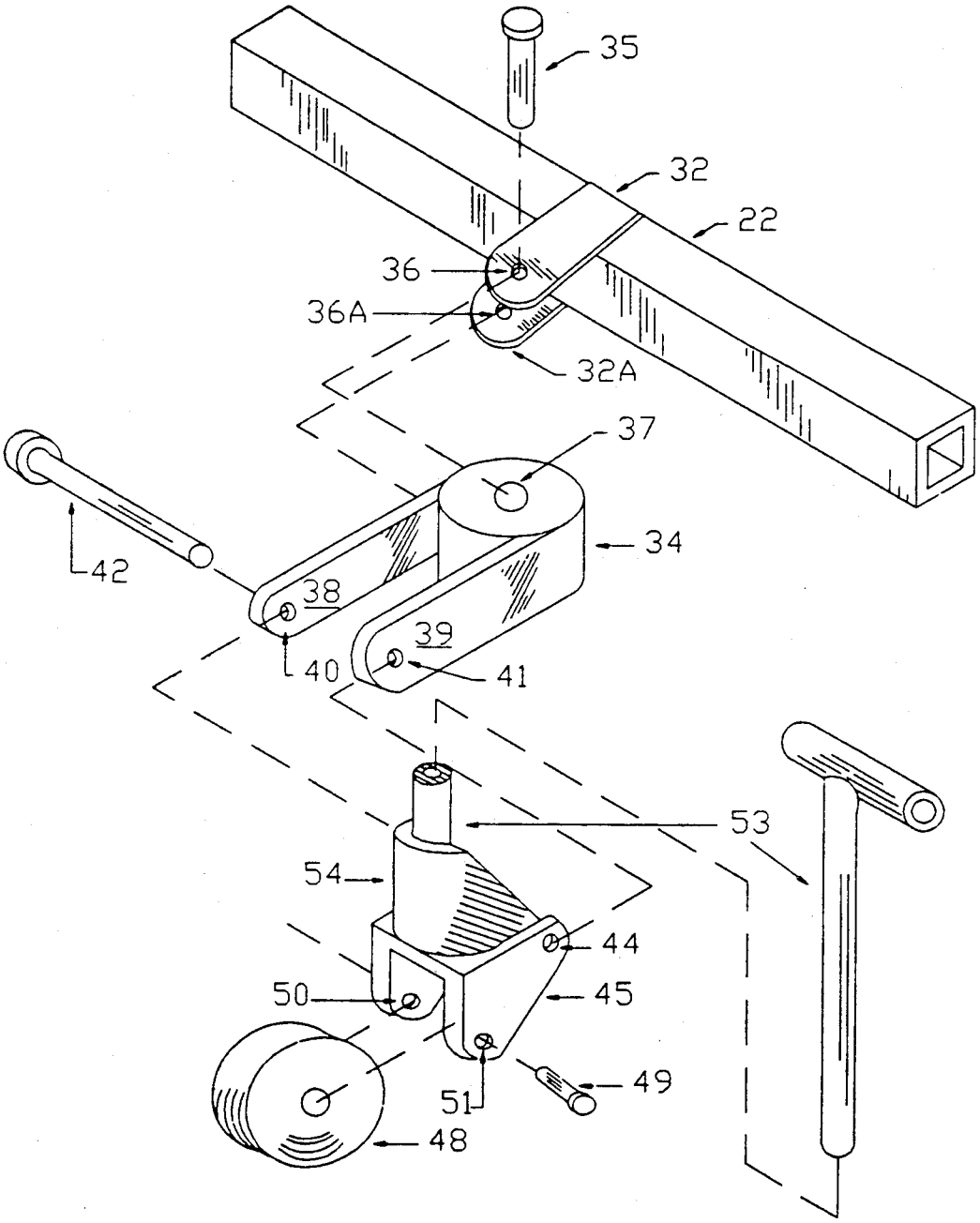
FIG. 6 is an enlarged and exploded perspective view of the caster wheel assembly for the positionable service bench of the present invention as seen looking in the direction of the arrows 6—6 of FIG. 5.

Caster swivel 34 is provided with a pair of aft extending spaced arms 38, 39 having aligned bores 40, 41 disposed on the tip ends thereof. A caster fork pivot pin 42 extends through bore 40 into aligned openings provided through caster fork 45 (one of which is shown in FIG. 6 and designated by reference numeral 44) and bore 41 to pivotally connect caster fork 45 to caster swivel 34. Caster wheel 48 is rotatably fixed in position by caster wheel axle 49 extending through the aligned bored holes 50, 51 of caster fork 45. An elongated T-shaped caster handle 53 is provided with an integrally enlarged base portion 54 that is welded or otherwise conventionally attached to the top horizontal plane surface of caster fork 45.

For moving the positionable service bench 20 from one location to another, caster handle 53 is pivotally moved about caster fork pivot pin 42 from the upright vertical position shown in FIGS. 1-4 to a substantially forty-five degree angle, relative to the support surface, to thereby cause caster fork 45 to pivot about caster fork pivot pin 42 and move caster wheel 48 from the retracted position shown to a position engaging the support surface for bench 20. When caster wheel 48 engages the support surface, rest pads 28, 29 are lifted from the surface to permit rotation of front wheels 23, 25 and caster wheel 48 for effecting easy movement of bench 20 by exerting the required pulling or pushing force on handle 53. When positionable service bench 20 is located in the desired work area, caster handle 53 is again pivotally moved to the upright position to retract caster wheel 48 to the position shown in FIGS. 1-and permit rest pads 28, 29 to again engage the floor, deck, or other support surface, and maintain bench 20 in fixed position. Suitable cotter pins, friction retention washers, or similar conventional retention devices are employed to retain each of axles 24, 26, 49 and swivel pin 35 in position and are not illustrated or further described herein in the interest of brevity.

Referring back to FIGS. 1-4, positionable service bench 20 includes a vertical mast structure designated generally by reference numeral 56. Vertical mast structure 56 includes a pair of spaced vertical extending elongated members 58, 59 formed of U-channel structural material disposed with the open channels in facing relationship. Vertical extending elongated members 58, 59 are disposed on opposite sides of the caster swivel acceptor plates 32, **32*a* and bolted, or otherwise releasably fixed at one end thereof, to the cross member of U-shaped horizontal base 22, as will be further explained hereinafter. The opposite spaced ends of vertical extending elongated members 58, 59 are connected via a cross bar 60 welded, or otherwise conventionally attached thereto, to form a rectangular mast structure 56. A cable pulley or sheave mounting bracket 62 is welded or otherwise fixedly attached at substantially the intermediate length of cross bar 60. Cable sheave mounting bracket 62 is provided with a pair of spaced plates angularly extending aft of vertical mast structure 56. A cable sheave 63 is rotatably supported at the end of and between the spaced plates of sheave mounting bracket 62 via a cable sheave pin 64 extending therethrough. An opening 65 (FIG. 4) provided through the center of cable sheave mounting bracket 62 and cross bar 60 serves to receive one end of cable 66 extending around sheave 63**, as will be further explained hereinafter.

Figure 11:
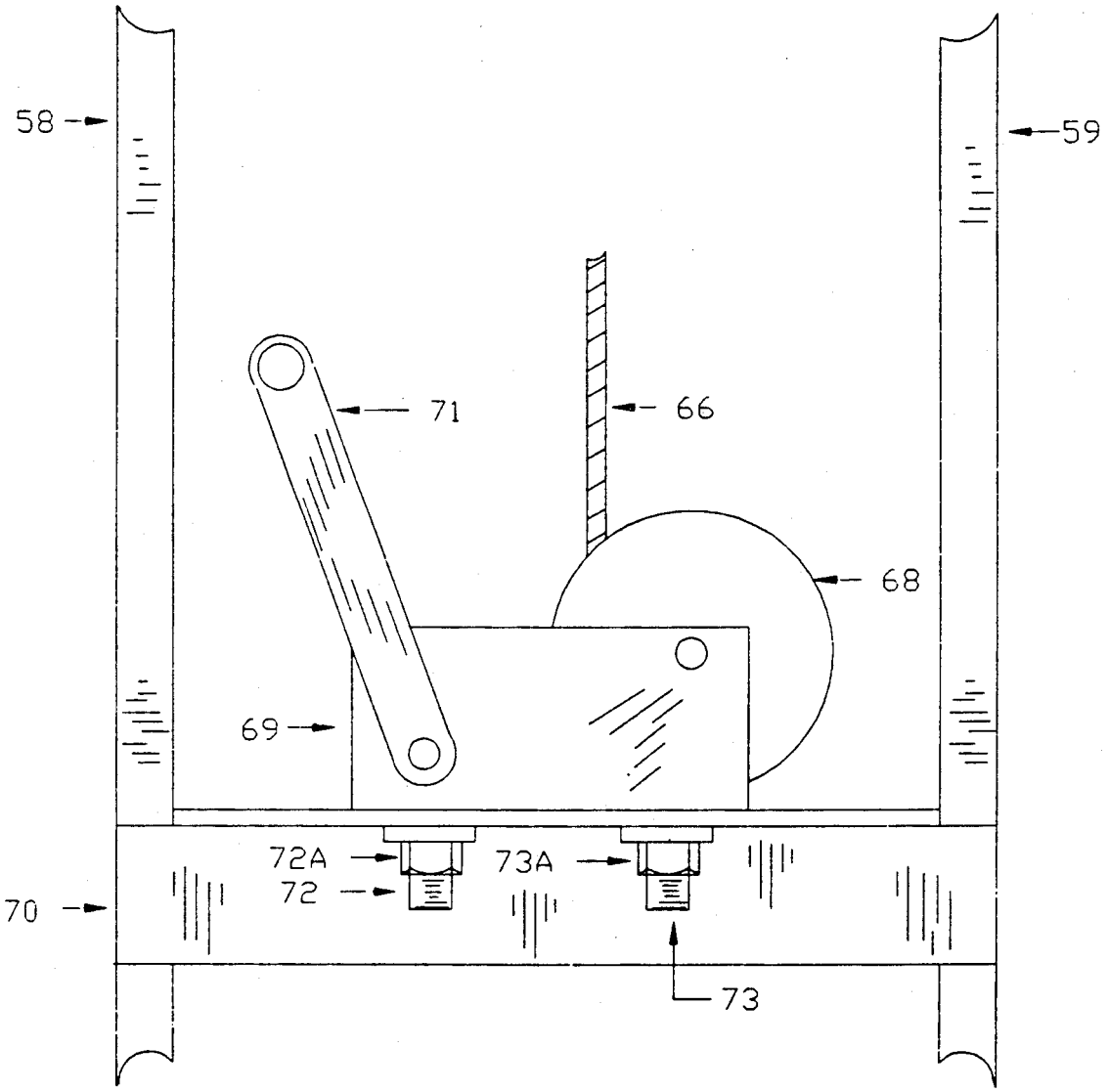
FIG. 11 is a view of the elevator windlass system as seen looking in the direction of arrows 11—11 of FIG. 1.

The other end of cable 66 is secured to the hub of a winch or windlass 68. Winch 68 is rotatably supported within a frame 69 having a pair of vertical ends and a flat horizontal base. A winch handle 71 extends through the vertical ends of frame 69 and is geared through a suitable conventional gear arrangement (not illustrated) to effect manual rotation of winch 68. As shown more clearly in FIG. 11, a winch mounting base 70 for winch 68 is welded, or otherwise conventionally attached to and spans the transverse distance between vertical members 58, 59 of mast 56. Winch mounting base 70 is provided with a partially tapered and aft extending shelf-like lip that permits the attachment of winch frame 69 thereto via bolts 72, 73 and nuts 72*a*, 73*a*. Manual rotation of winch handle 71 permits manual rotation of winch 68 to pay out and to retrieve cable 66 as will be further explained hereinafter.

The end of cable 66 extending through cross bar 60 extends through the top horizontal end of, and is secured within, an elevator assembly generally designated by reference numeral 75. Elevator assembly 75 is disposed for vertical movement along and between vertical members 58, 59 of vertical mast structure 56. Cable 66 is actually attached to safety brake yoke 76 disposed within elevator assembly 75, with the upward travel limit of safety brake yoke 76 being limited by yoke stop 74. As shown more clearly in FIG. 3, yoke stop 74 is a protrusion rigidly attached to the center inside top horizontal wall surface of elevator assembly 75.

Figure 7:
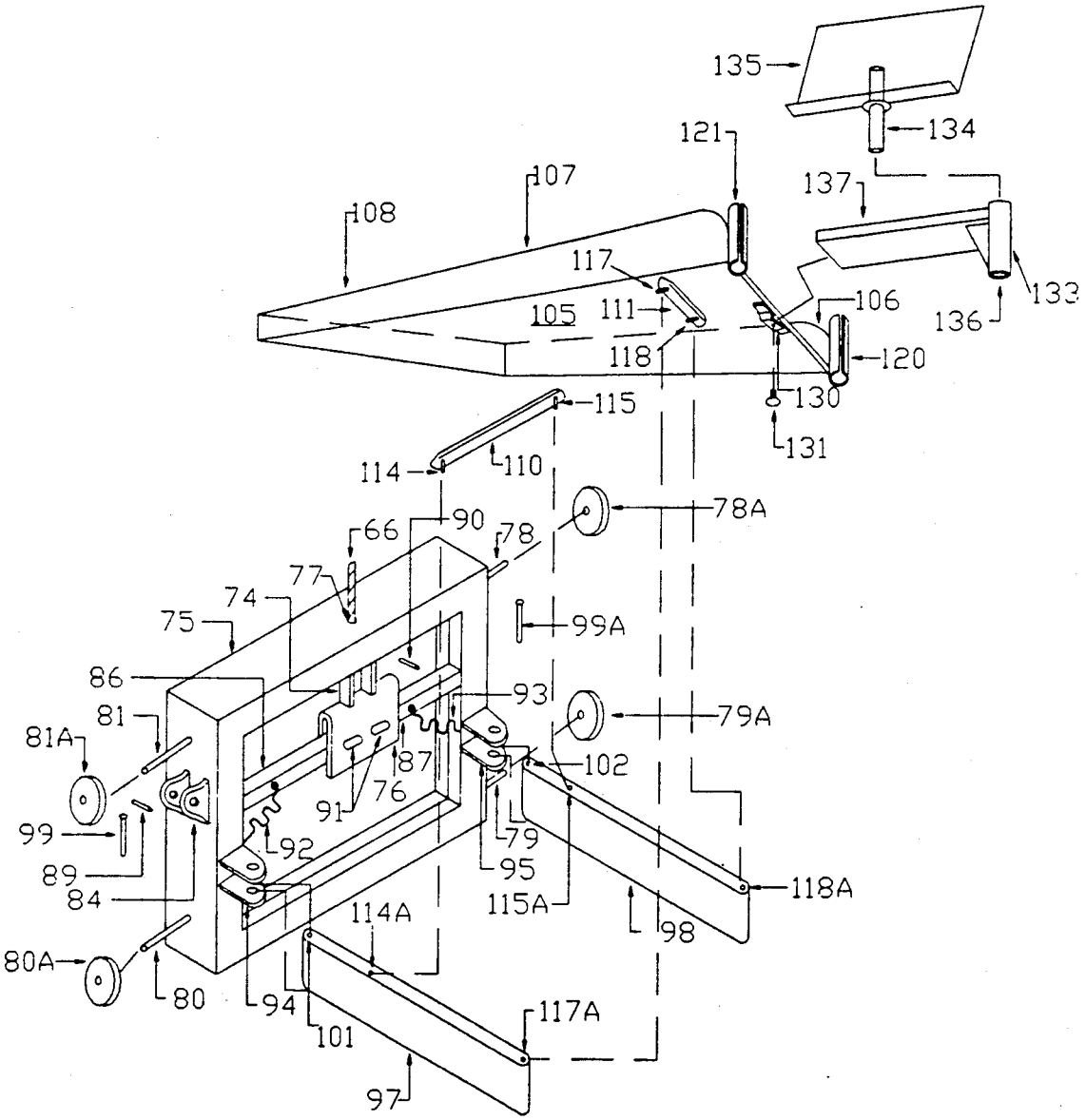
FIG. 7 is an enlarged and exploded perspective of the elevator assembly, tool tray support structure, and horizontal tool tray, with some of the tray attachments shown and others omitted, as seen looking in the direction of arrows 7—7 of FIG. 1.

The details of elevator assembly 75 are more clearly illustrated in the exploded view of FIG. 7. As shown therein, elevator assembly 75 includes an essentially square frame structure with cable 66 passing through an opening 77 provided in the top horizontal end of the square frame and attached to safety brake yoke 76. Four dolly axles, designated by reference numerals 78, 79, 80 and 81 are integral with and extend horizontally from the opposing vertical sides adjacent to opposing corners of the square frame structure of elevator assembly 75. Dollies for each of these axles are rotatably disposed thereon and designated by reference numerals 78*a*, 79*a*, 80*a*, and 81*a*. Dollies 78*a* and 79*a* are disposed within the open channel of vertical member 59 while dollies 80*a* and 81*a* are disposed within the open channel of vertical member 58 of mast structure 56. A pair of safety brake arm mounts, one of which is illustrated in FIG. 7 and designated by reference numeral 84, are also disposed on the vertical sides of elevator assembly 75. The outermost or outboard ends of safety brake arms 86, 87 are respectively received through and pinned to brake arm mount 84, and the one not shown, by suitable pins 89 and 90. The opposing ends of safety brake arms 86, 87 are positioned on opposing sides of safety brake yoke 76 and pinned thereto via safety brake yoke inboard pins 91. A pair of safety brake springs are illustrated in FIG. 7 and designated by reference numerals 92 and 93 and are secured in a conventional manner to the inside vertical walls of elevator assembly 75 and through small diameter drilled holes provided in safety brake arms 86, 87.

In the event of the failure or disconnection of cable 66, safety brake springs 92 and 93 will pull safety brake yoke 76 away from its normal resting position against yoke stop 74. Yoke stop 74 is centered and rigidly connected to the top inside horizontal surface of elevator assembly 75. Safety brake yoke 76 will be springably pulled downward thereby forcing safety brake arms 86 and 87 to pivot. The lowermost bottom outboard corners of safety brake arms 86 and 87 will forcibly engage the vertical sidewalls of vertical members 58 and 59. This forceable engagement will prevent the unexpected fall of elevator assembly 75.

A pair of tray support arm mounts are integral with and disposed in spaced relationship on a side surface of each of the vertical walls of elevator assembly 75, as shown in FIG. 7, and as designated by reference numerals 94, 95. A pair of elongated tray support arms 97, 98, provided with arcuate end surfaces, are pivotally secured at one end thereof the respective pairs of tray support arm mounts 94, 95 via support arm pins 99, 99*a*. Support arm pins 99, 99*a* extend through support arm mounts 94, 95 and the vertical end smooth surface bores 101 and 102 of respective tray support arms 97, 98. Suitable securing devices such as cotter pins, friction washers, or the like (not illustrated), are employed to maintain support arm pins 99, 99*a* in position. A tool tray 105 having vertically extending sides 106 and 107 and a vertically extending end portion 108 is supported on support arms 97, 98 by rear tray support 110 and support arm tie rod 111. Rear tray support 110 is provided with a pair of depending dowel pins, designated by reference numerals 114, 115 that engage the center smooth vertical bores 114*a* and 115*a* respectively in support arms 97, 98. Support arm tie rod 111 is rigidly connected and centered to the bottom frontal portion of tool tray 105 as illustrated. Depending dowel pins 117 and 118 engage the smooth vertical bores 117*a* and 118*a* disposed on the end of support arms 97, 98 opposite to the ends thereof connected to tray support arm mounts 94, 95.

A pair of light brackets 120, 121 are rigidly connected to the respective corners of tool tray 105 at the intersection of respective vertical sides 106, 107 with the open end of tray 105. An electrical light fixture 123 may be selectively located on either side of tool tray 105 with the stem base thereof being accepted by either of light brackets 120, 121. An exemplary light fixture employed in the preferred embodiment of the present invention is a disc and collar arm type arrangement supplied by MSC Industrial Supply Co., 1551 W. Evans Avenue, Denver, Colo. 80223, and manufactured by Fostoria Industries, 1982 N. Main Street, Fostoria, Ohio 44831.

Figure 2:
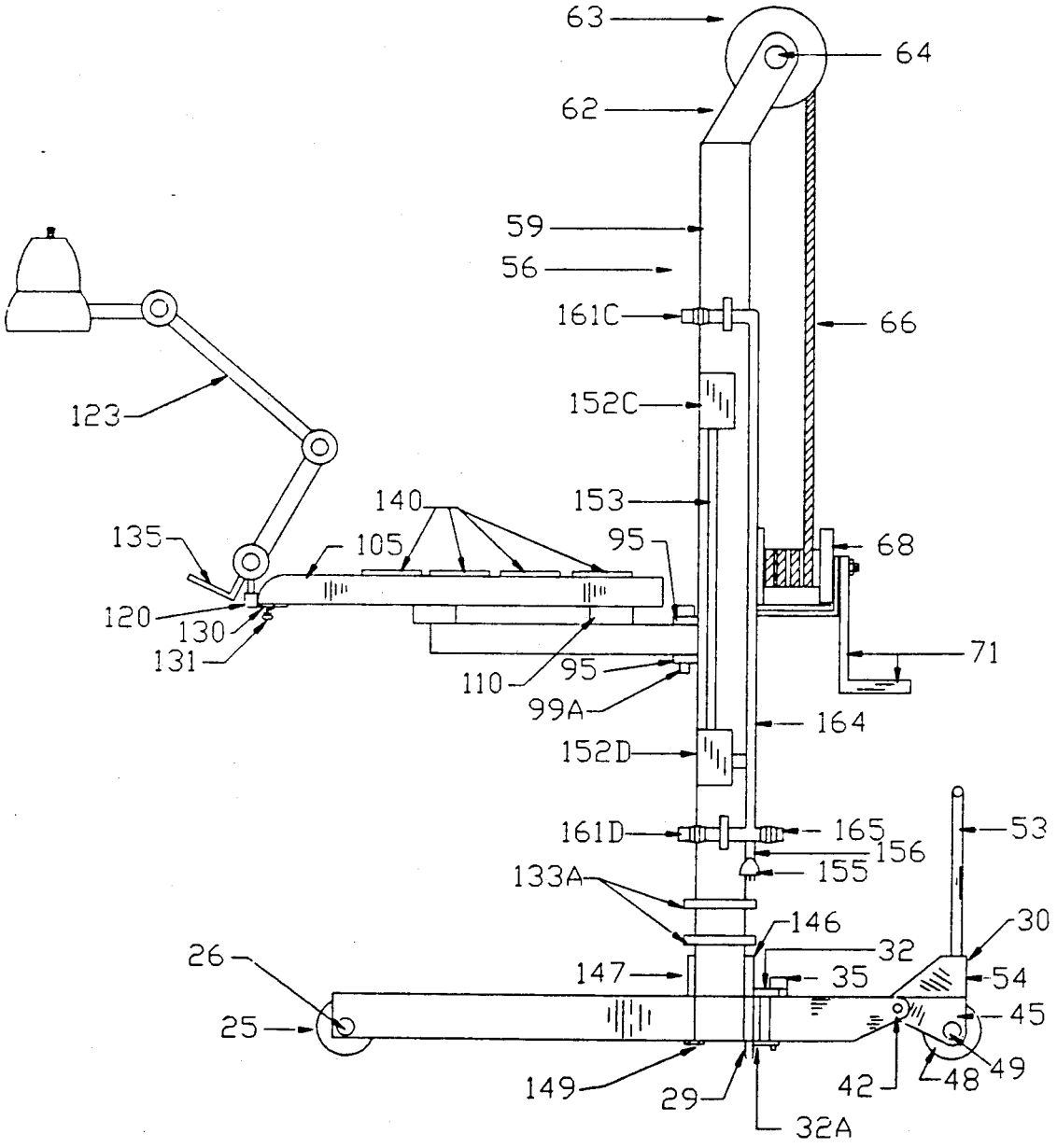
FIG. 2 is a side elevation of the positionable service bench shown in FIG. 1 and illustrating the opposite side thereof.
Figure 3:
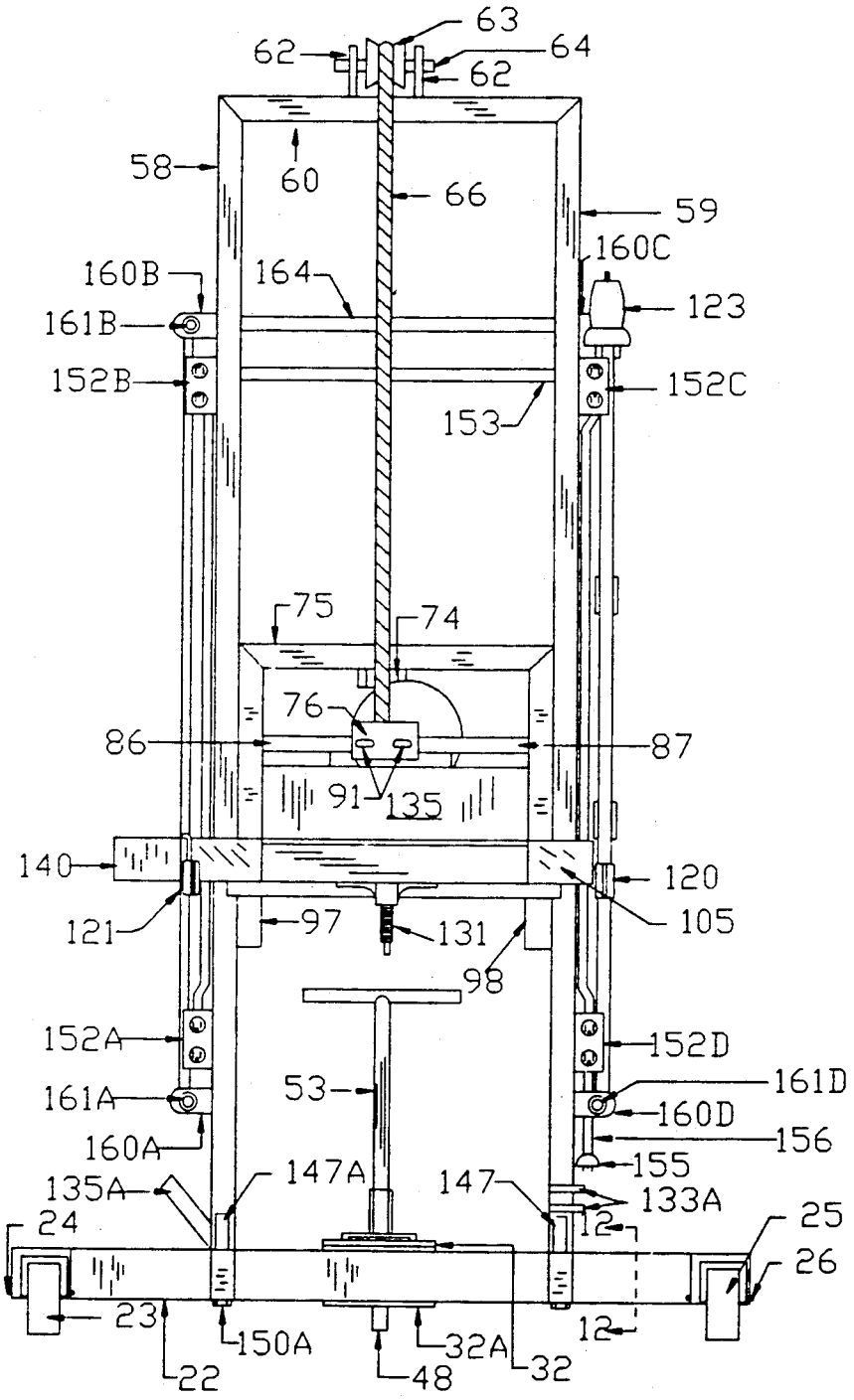
FIG. 3 is a front elevation of the positionable service bench shown in FIGS. 1 and 2.

A service manual bracket receptacle 130 is welded or otherwise rigidly connected to the underside, front center portion and flush with the open end of tool tray 105. Bracket receptacle 130 is provided with a set screw 131 to fix the received service manual holder bracket 133 therein. A stem 134 of service manual holder 135 is rotatably and slidably received within smooth bore 136 of service manual holder bracket 133. The rectangular support shaft 137 of service manual holder bracket 133 is positioned into service manual bracket receptacle 130 and retained at the desired depth therein by service manual bracket receptacle set screw 131. Service manual holder 135 is provided with a shelf and sloping support surface to maintain a service manual thereon in the open position. When not in use, service manual holder 135 is stored by inserting stem 134 thereof within service manual storage bracket 135*a* welded or otherwise conventionally secured to and adjacent to the base of vertical member 58 of mast structure 56 (illustrated in FIGS. 1 and 3). Similarly, service manual holder bracket 133, when not in use, is stored by inserting rectangular support shaft 137 thereof through openings provided in bracket members 133*a* that are welded, or otherwise conventionally secured to and adjacent to the base of vertical member 59 of mast structure 56 (FIGS. 2 and 3).

Figure 4:
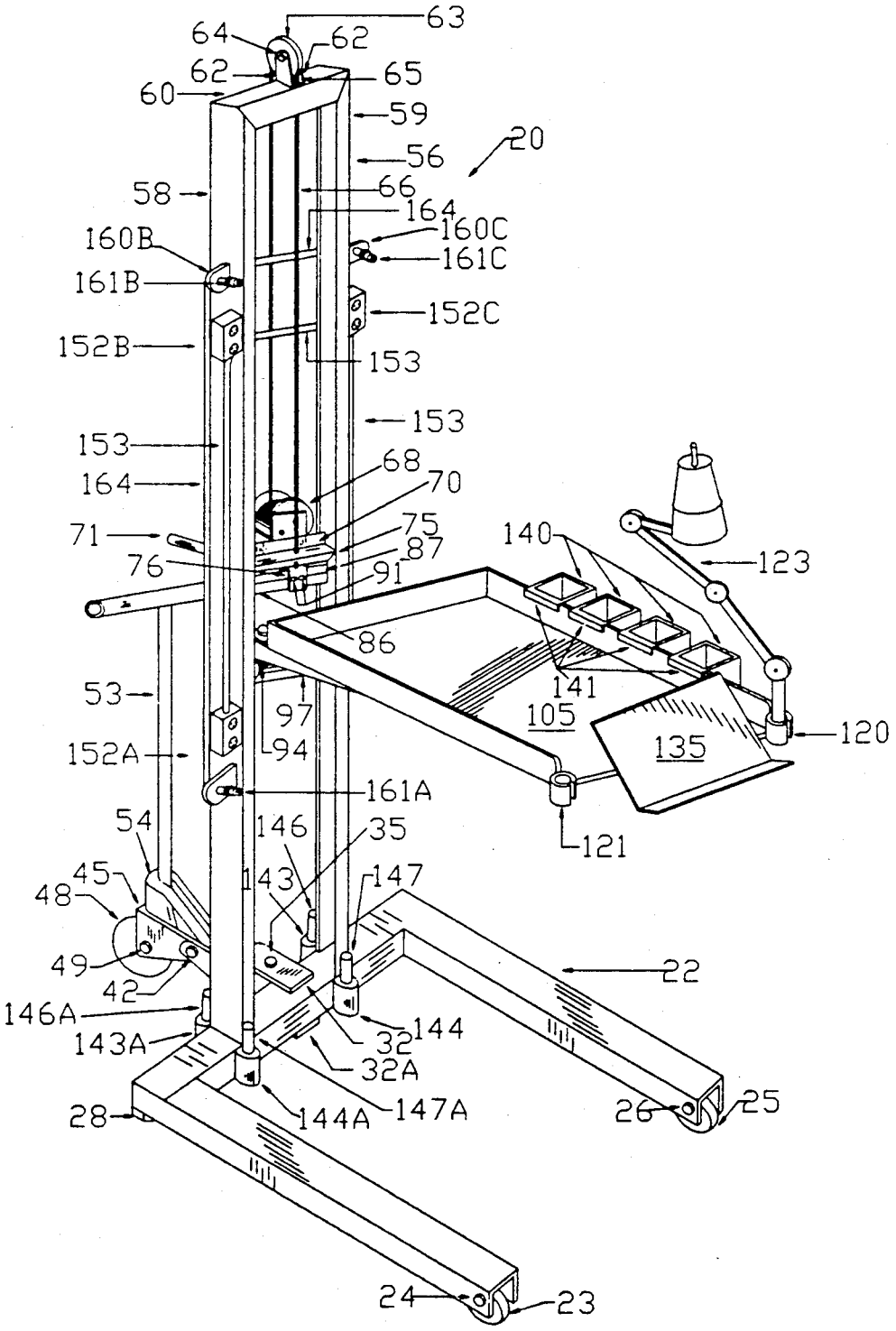
FIG. 4 is a perspective view of the positionable service bench shown in FIGS. 1-3.
Figure 5:
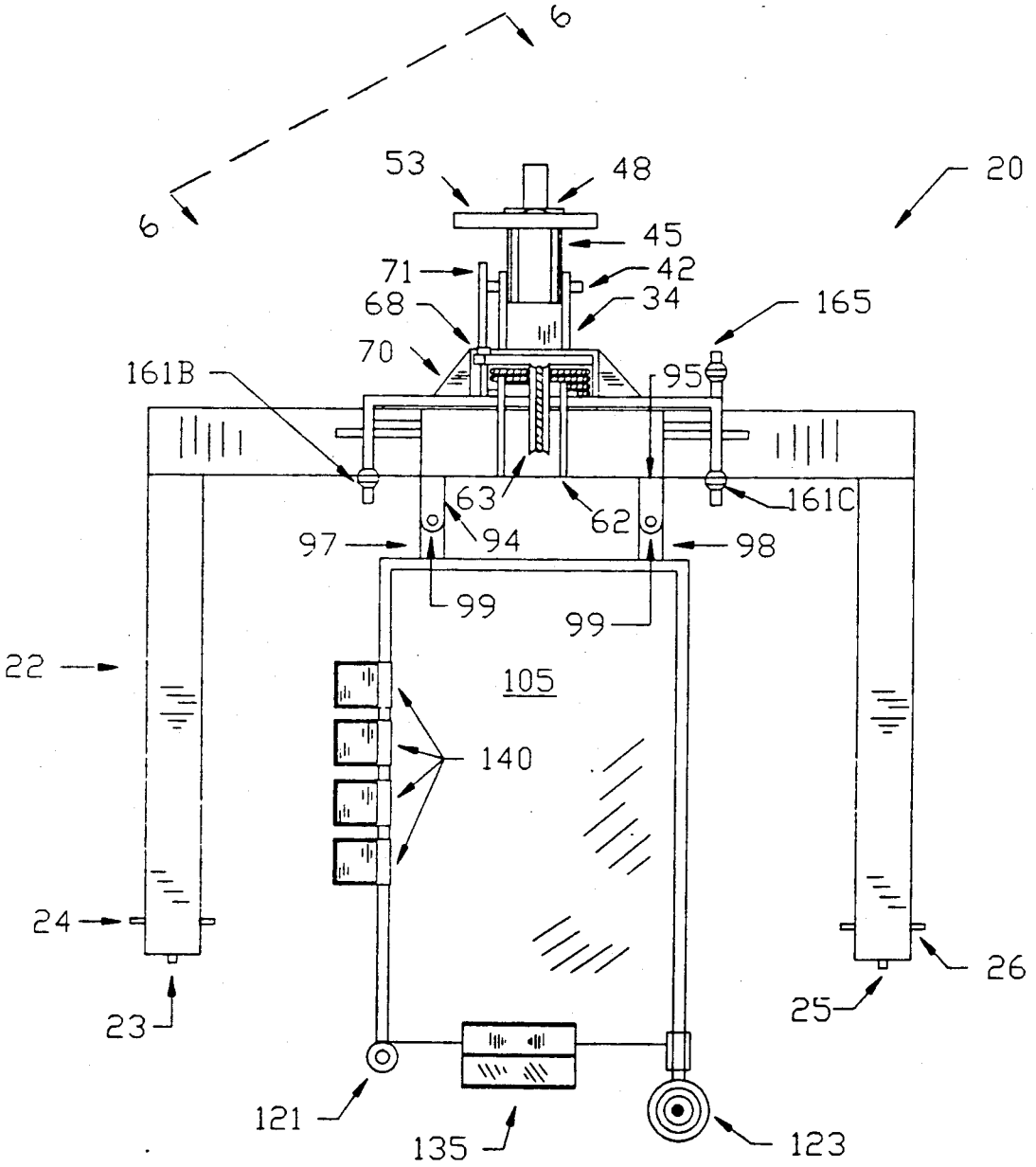
FIG. 5 is a part sectional, part plan, view of the positionable service bench of the present invention as seen when taken along and looking in the direction of line 5—5 of FIG. 1.
Figure 9:
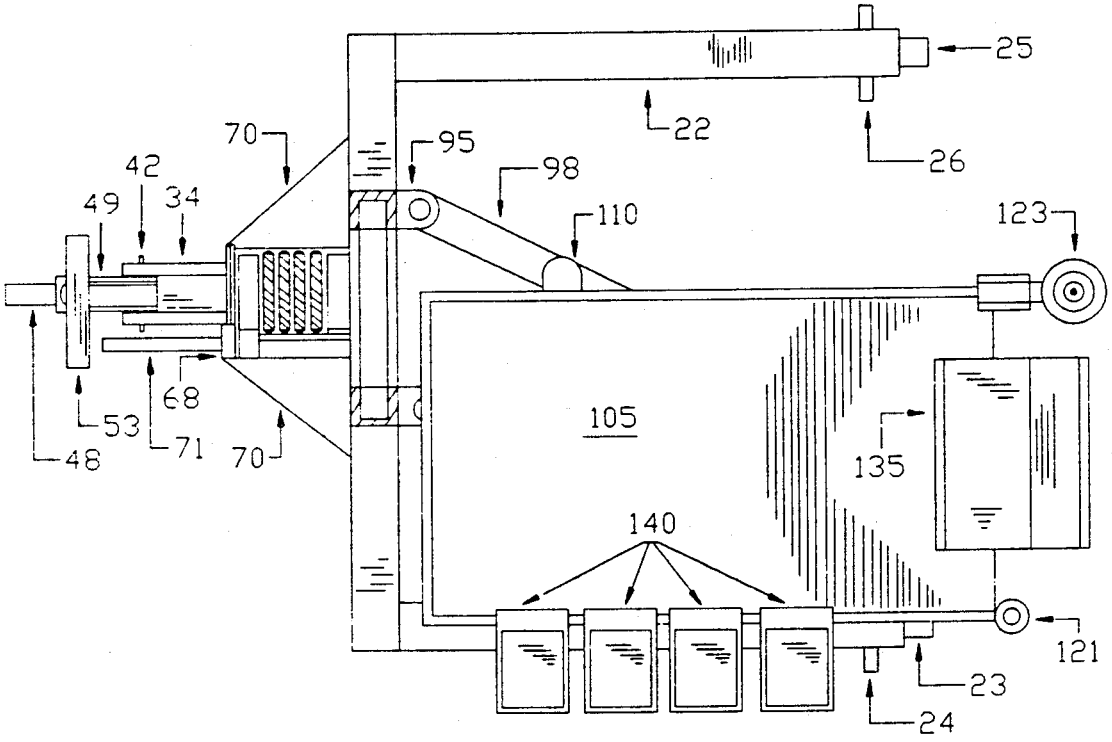
FIG. 9 is a part sectional, part plan view of the positionable service bench of the present invention as seen when taken along and seen looking in the direction of line 9—9 of FIG. 1 and illustrating the horizontal tool tray in one extreme lateral position.
Figure 10:
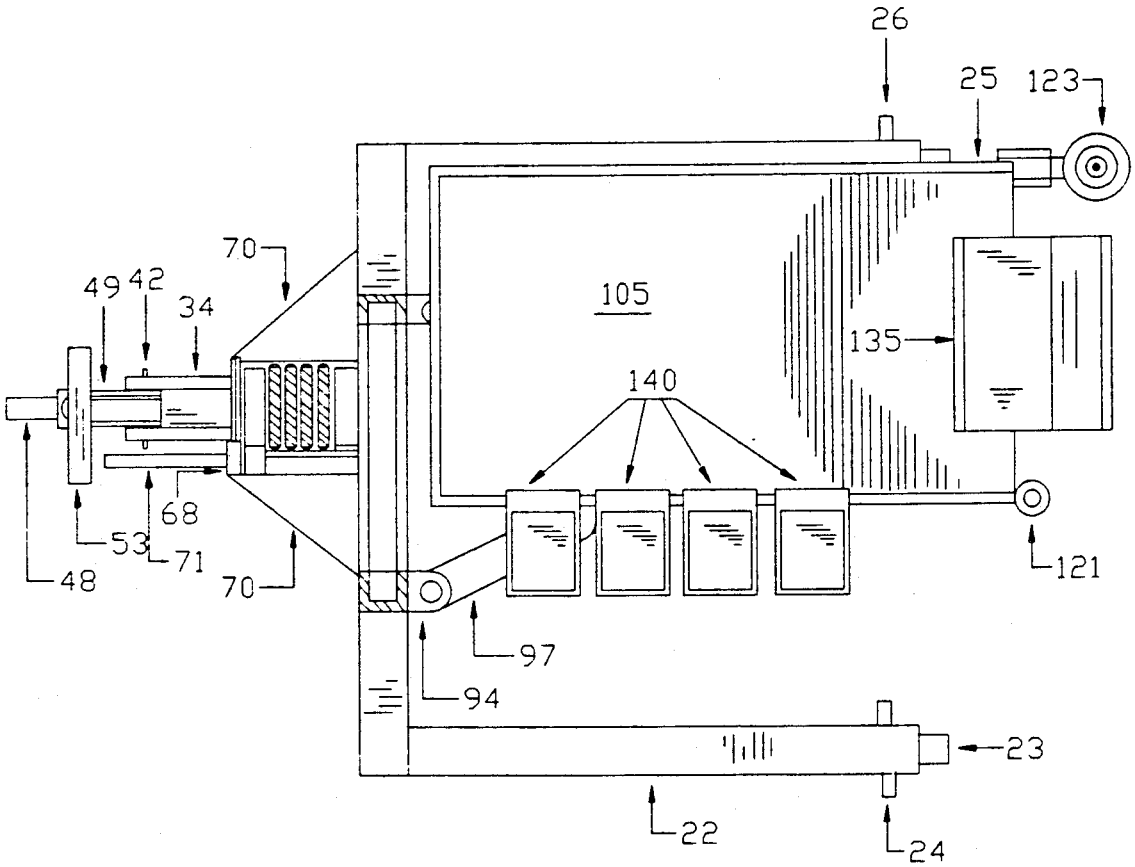
FIG. 10 is a view similar to FIG. 9 and illustrates the horizontal tool tray in the other extreme lateral position.

A plurality of containers or compartments 140, as illustrated in FIGS. 4, 9 and 10, is provided with overhanging lip surfaces 141 to permit releasable retention thereof by either one of the vertical sides 106, 107 of tool tray 105. Parts containers 140 assist in organizing the needed new parts employed in a maintenance or repair operation and serve to receive and maintain separate, and readily accessible, any removed parts from the equipment being worked on.

The lateral movement capability of tool tray 105 is illustrated in the two extreme positions of the tray in FIGS. 9 and 10. As shown therein, lateral movement of tray 105 is permitted by the pivot connection of tray support arms 97, 98 about pivot pins 99, 99*a*. The depending dowel pins 114 and 115 on rear tray support 110 freely pivot within the smooth bores 114*a* and 115*a* of support arms 97, 98. The depending dowel pins 117 and 118 on tie rod support arm 111 also freely pivot within the smooth bores 117*a*, 118*a* of support arms 97, 98 as tool tray 105 is laterally moved from the position shown in FIG. 9 to that shown in FIG. 10. Tray 105 may also be positioned at any point between the extreme lateral positions shown in FIGS. 9 and 10 that is convenient to the mechanic utilizing the positionable service bench 20. The design of tray support arm mounts 94, 95, support arms 97, 98 and their specific pivot connection with tray support 110 and tie rod support arm 111, will not permit the lateral positioning of tool tray 105 to exceed the extreme outside dimensions of horizontal base 22. These lateral travel limits ensure against the possibility of an unbalanced load on tray 105 causing service bench 20 to become unstable.

Figure 12:
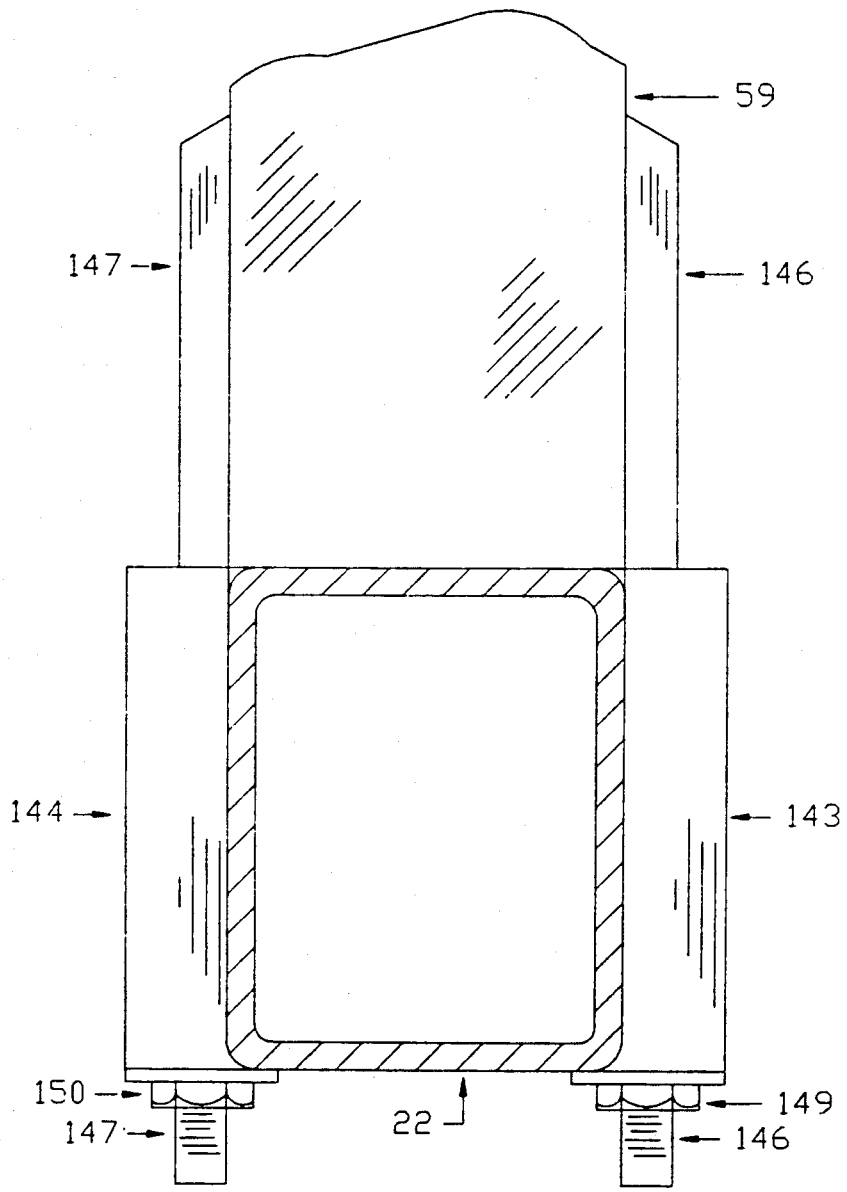
FIG. 12 is a sectional view as seen when taken along and looking in the direction of line 12—12 of FIG. 3 and illustrates the connection structure for the vertical mast and horizontal base portions of the positionable service bench of the present invention.

Referring now to FIG. 12, the details of the releasable attachment for vertical members 58, 59 of mast structure 56 to the horizontal base 22, and referred to hereinbefore, will now be described. In this part sectional view, only the details of the connection of vertical member 59 to the cross member of the square U-shaped horizontal base 22 are shown and described, it being understood that the connection for vertical member 58 is identical to that shown and described for vertical member 59. As shown in this embodiment, horizontal base 22 is formed of a rectangular cross-sectional area bar and provided with a pair of mast mounts 143, 144 welded to opposite vertical exterior surfaces thereof. Each of mast mounts 143, 144 is provided with a smooth bore extending longitudinally therethrough and serve to slidably receive respective mast assembly anchoring bolts 146, 147. A pair of mast assembly lock nuts 149, 150 are threadingly positioned on the end portions of the respective mast assembly anchoring bolts 146, 147 extending through the bored mast mounts 143, 144.

As shown more clearly in FIG. 4, mast mounts for vertical member 58 are designated by reference numerals 143*a*, 144*a*, while mast assembly anchoring bolts for vertical member 58 are designated by reference numerals 146*a*, 147*a* and mast assembly lock nuts for vertical member 58 are designated by reference numerals 149*a* and 150*a*.

Positionable service bench 20 is also provided with a plurality of standard 110 V twin outlet boxes secured to the outside surfaces of vertical members 58, 59 of mast structure 56. In the preferred embodiment illustrated in FIGS. 1–4 two outlet boxes 152*a* and 152*b* are positioned in spaced relationship on vertical member 58 and two outlet boxes 152*c* and 152*d* are disposed in spaced relationship on vertical member 59 of mast structure 56. A rigid conduit 153 provides electrical connection between the outlet boxes. A male electric plug 155 connectable to a conventional electrical source (not shown) supplies 110 V electrical current, via conduit 156 leading to outlet box 152*d*, to all of the outlet boxes. Light fixture 123, described hereinbefore, may be plugged into either of the outlet boxes.

Four air chuck mounting plates, designated by reference numerals 160*a*, 160*b*, 160*c* and 160*d* are also welded or otherwise secured to mast structure 56. Two air chuck mounting plates 160*a* and 160*b*, supporting respective air chucks 161*a* and 161*b*, are positioned in spaced relationship on vertical member 58. The other two air chuck mounting plates 160*c* and 160*d*, supporting respective air chucks 161*c* and 161*d*, are positioned in spaced vertical relationship on vertical member 59. A continuous air manifold 164 interconnects air chucks 161*a*, 161*b*, 161*c* and 161*d*. Manifold supply connection 165, in connection with continuous air manifold 164, is connectable to a continuous pressurized air supply source (not shown) and serves to supply pressurized air as needed to continuous air manifold 164 and air chucks 161*a*, 161*b*, 161*c* and 161*d* for operation of air pressure tools as needed by the mechanic utilizing positionable service bench 20.

Figure 8:
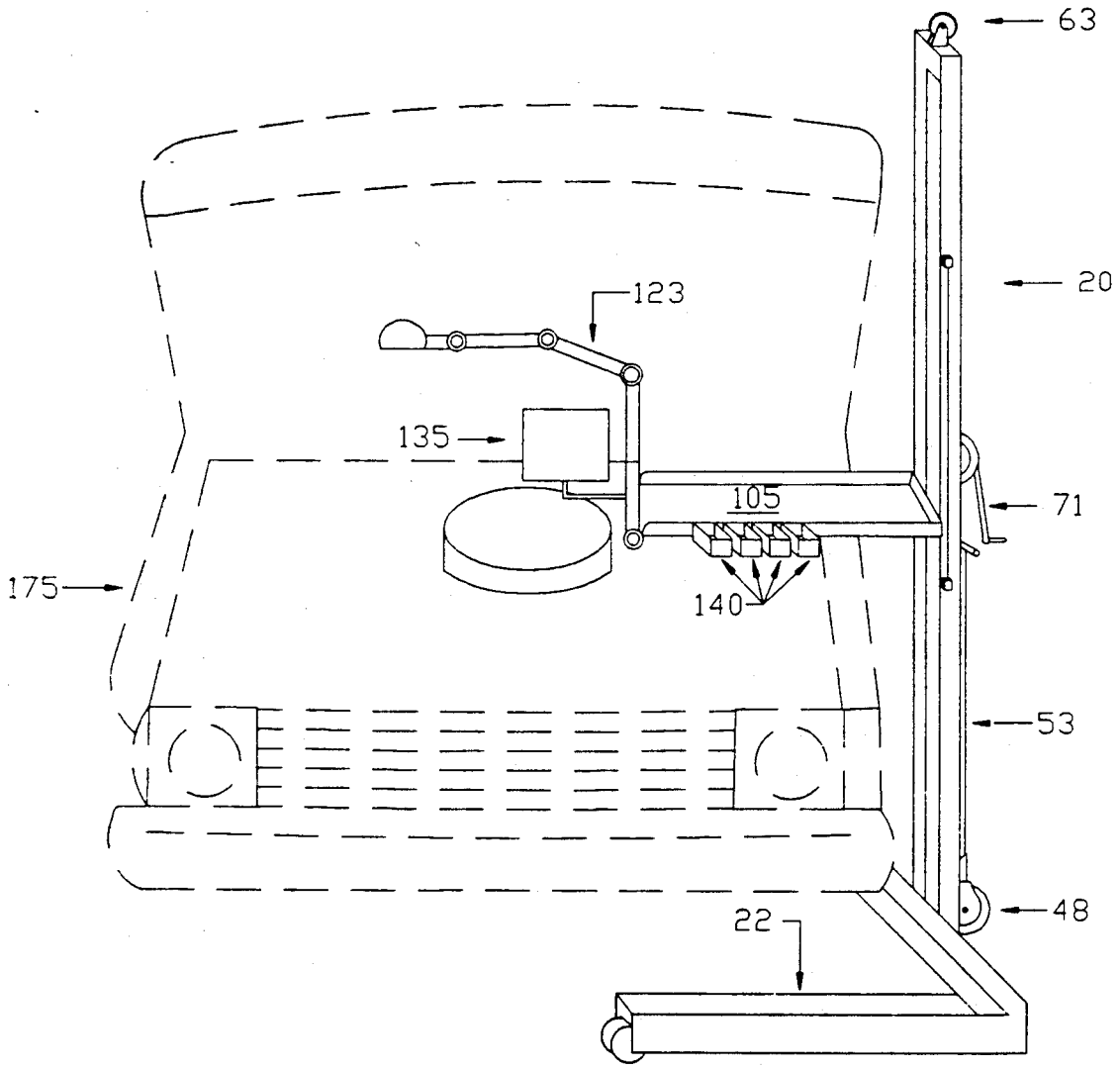
FIG. 8 is part schematic view of the positionable service bench of the present invention in position for use by a mechanic to work on an exemplary mobile piece of equipment.

The operation of the invention is believed apparent from the above description. The mechanic or technician utilizing postionable service bench loads tool tray 105 and parts containers 140 with the tools and parts believed necessary for the selected repair or maintenance anticipated. Caster handle 53 is then moved from the vertical at rest position shown in FIGS. 1–4 to an approximate forty-five degree angle from the floor support surface to raise rest pads 28, 29 and place caster wheel 48 in contact with the floor support surface. Bench 20 is then moved via exerting force on caster handle 53 to the work site, an example of which is illustrated in FIG. 8.

At the work site, winch handle 71 is manually rotated in either a clockwise or counter clockwise direction to change the height of elevator assembly 75 and the supported tool tray 105 to that desired. Positionable service bench 20 is then moved to the position shown in FIG. 8 with the open square U-shaped horizontal base 22 positioned about the front tire of vehical 175 and tool tray extending under the vehicle hood in easy access to the mechanic. An electrical power source and an air pressure supply source are placed in connection with the respective electrical outlets and air chucks on bench 20 as described hereinbefore. With light fixture 123 disposed in electrical connection with one of the electrical outlets, service manual holder 135 and the appropriate service manual positioned thereon, all tools necessary for the intended job and all required small parts therefore being within arms reach on tool tray 105 and containers 140, the mechanic working on vehicle 175 can proceed with the planned repair or maintenance without interruption, and without making any required trips to obtain additional tools or equipment.

It is thus seen that the positionable service bench 20 described herein permits the performance of a multitude of service, maintenance, and repair applications with the ever-constant problem of positioning and supporting tools and test equipment at the specific job site being managed in a safe, organized manner. Although the specific illustration utilizing the positionable service bench 20 shown in FIG. 8 is for automobile repair or maintenance, the invention is not so limited. Other examples of intended applications are large and heavy truck repair and maintenance, large agricultural equipment repair and maintenance, small aircraft repair and maintenance, general in-shop service and repair of various types of machinery and equipment. No specific materials or dimensions have been described for constructing positionable service bench 20 and the component parts thereof, it being understood that these may vary according to the job applications intended for the invention. The use of stainless steel and other steel alloys, as well as aluminum and aluminum alloys and possible structural composites may be utilized for constructing the horizontal base 22, vertical mast structure 56 and other components of positionable service bench 20. Also, it is naturally understood that the width and height dimensions of horizontal base 22 and vertical mast structure 56 will vary depending upon the application or intended use of the positionable service bench.

By supplying the mechanic or service technician with the convenient, organized, and close-at-hand tool support surface and service bench of the present invention, many unsafe and time-consuming maintenance practices can be improved upon. The positionable service bench 20 of the present invention has the additional advantages of a low profile base that assists in positioning and maneuvering around obvious obstructions and permits the user to select the desired vertical height and lateral position for the tool tray 105. This latter feature reduces the need for the service person to climb down from an elevated work site to retrieve a tool or part from a remotely positioned tool box or work bench, and provides the benefit of bringing the tool tray into even closer proximity to the user to thereby reduce unproductive, repetitious and fatiguing turning and reaching for tools, parts and/or equipment. In addition, the proximity of a light source for illuminating the specific or general work area, the 110 V electrical receptacles and air chucks to power various electrical or pneumatic tools used in maintenance and repair operations, and the removable small parts containers providing access or storage for small and miscellaneous parts all are valuable features of the positionable service bench of the present invention.

Although the invention has been described relative to specific embodiments thereof, it is not so limited and there are numerous modifications and variations thereof that will be readily apparent to those skilled in the art. For example, the square U-configured horizontal base 22 described herein could be replaced with an H-configured horizontal base or any one of several different configurations when more weight or strength is deemed necessary for the base portion of positionable service bench 20. Also, the hand operated winch 68 could be replaced with any of several lifting devices such as a lead screw and nut arrangement, hydraulic or pneumatic cylinders, electric motors, or air motors without departing from the spirit or scope of the present invention. Also, the mechanism for providing lateral movement to the tool tray 105 could be accomplished by an elbow joint single arm, or a quadrant roller assembly. These and other variations and modifications of the described invention may be readily apparent to those skilled in the art in the light of the above teachings, and it is to be understood that, within the scope of the appended claims, the invention may be practiced other than as specifically described herein.

What is claimed as new and desired to be secured by Letters Patent of the United States is:

1. A positionable service bench facilitating mechanical work at a work station by one or more mechanics comprising:

a horizontal base assembly;

support structure secured to said horizontal base assembly and engaging a support surface;

said support structure including means selectively facilitating and impeding movement of said horizontal base assembly about said support surface;

a vertical mast secured to said horizontal base assembly;

elevator means disposed on, and selectively movable up and down, said vertical mast;

linear tool tray support structure secured to and movable with said elevator means;

a horizontal tool tray having a planar bottom and at least three vertically extending sides supported by said linear tool tray support structure;

said horizontal tool tray serving to receive and support hand tools for use by one or more mechanics at the work station;

said linear tool tray support structure being pivotally connected at one end to said elevator means and releasably attached to said planar bottom of said horizontal tool tray at the other end thereof;

said horizontal tool tray being pivotally and horizontally movable relative to said vertical mast to adjust the relative position thereof;

said at least three vertically extending sides on said horizontal tool tray including a first vertical side disposed adjacent a rectangular frame of said elevator means and second and third sides each having a first end connected to the ends of said first side to leave an open end for said horizontal tool tray spaced from said elevator means;

an accessory receiving bracket for receiving an accessory support secured to a second end of each of said second and third sides at the open end of said horizontal tool tray;

said vertical mast including a pair of spaced vertical columns and said elevator means including said rectangular frame movably supported between said pair of spaced vertical columns;

said rectangular frame including a pair of vertical sides and a pair of horizontal sides;

an elongated arm member pivotally attached at one end to, and extending in a horizontal direction from, each member of said pair of vertical sides of said rectangular frame and serving as said liner tool tray support structure;

whereby, when said positionable service bench is moved to a work station and secured in position by said means selectively facilitating and impeding movement thereof, said elevator means may be moved to the desired height on said vertical mast and said horizontal tool tray may be pivotally and horizontally adjusted to the position desired by the mechanic working at the work station.

2. The positionable service bench of claim 1 wherein each said elongated arm member pivotally attached at one end to said pair of vertical sides of said rectangular frame is provided with a vertically extending opening adjacent the other end thereof and including a tie rod secured to the planar bottom surface of said horizontal tool tray and having a pair of dowels extending therefrom engaging said vertically extending openings in the ends of said longated arm members.

3. The positionable service bench of claim 1 wherein each said elongated arm pivotally attached at one end to said pair of vertical sides of said rectangular frame is provided with a vertically extending opening substantially intermediate the length thereof and including a support arm tie rod having a pair of dowels extending therefrom engaging said vertically extending openings intermediate said elongated arm members.

4. The positionable service bench of claim 1 including an additional accessory receiving bracket releasably secured to and extending from said planar bottom at the open end of said horizontal tool tray and positioned substantially intermediate said accessory receiving brackets secured to said second and third sides of said horizontal tool tray.

5. The positionable service bench of claim 4 wherein each of said accessory receiving brackets on said horizontal tool tray comprises a tubular socket extending in a vertical direction relative to said support frame; and at least one accessory support releasably received within one of said accessory receiving brackets.

6. The positionable service bench of claim 5 wherein said at least one accessory support releasably received within one of said means for receiving an accessory support is selected from the group of accessories consisting of:

an electric light assembly and a service manual holder.

7. A positionable service bench facilitating mechanical work at a work station by one or more mechanics comprising:

a horizontal base assembly;

support structure secured to said horizontal base assembly and engaging a support surface;

said support structure including means selectively facilitating and impeding movement of said horizontal base assembly about said support surface;

a vertical mast secured to said horizontal base assembly;

elevator means disposed on, and selectively movable up and down, said vertical mast;

linear tool tray support structure secured to and movable with said elevator means;

a horizontal tool tray having a planar bottom and at least three vertically extending sides supported by said linear tool tray support structure;

said horizontal tool tray serving to receive and support hand tools for use by one or more mechanics at the work station;

said linear tool tray support structure being pivotally connected at one end to said elevator means and releasably attached to said planar bottom of said horizontal tool tray at the other end thereof;

at least one removable parts tray;

said at least one removable parts tray having an overhanging lip structure extending from an open top surface thereof;

said overhanging lip structure being slidably positioned over one of said vertically extending sides of said horizontal tool tray to releasably retain said removable parts tray on said positionable service bench;

said horizontal tool tray being pivotally and horizontally movable relative to said vertical mast to adjust the relative position thereof;

whereby, when said positionable service bench is moved to a work station and secured in position by said means selectively facilitating and impeding movement thereof, said elevator means may be moved to the desired height on said vertical mast and said horizontal tool tray may be pivotally and horizontally adjusted to the position desired by the mechanic working at the work station.

8. The positionable service bench of claim 7 including at least one air manifold supported by said vertical mast, an air supply chuck attached to and in fluid communication with said air manifold, and at least one exit air chuck in fluid communication with said air manifold and supported by said vertical mast in position for use by a mechanic when air tool use is needed at the work site.

9. The positionable service bench of claim 8 wherein said vertical mast includes a pair of spaced columns and said at least one exit air chuck includes at least one air chuck disposed on each member of said pair of spaced columns.

10. The positionable service bench of claim 7 including at least one electric outlet disposed on said vertical mast and in position for use by a mechanic at the work site when electric power tools are needed, and means for connecting said at least one electric outlet to an electric power supply.

11. The positionable service bench of claim 10 wherein said vertical mast comprises a pair of spaced vertical columns and said at least one electric outlet disposed on said vertical mast includes at least one electric outlet disposed on each member of said pair of spaced columns.

12. A positionable service bench facilitating repair and maintenance of mobile and stationary equipment comprising:

a horizontal base assembly;

a vertical mast releasable secured to said horizontal base assembly;

means supporting and selectively facilitating and impeding movement of said horizontal base assembly about a support surface;

elevator means disposed on, and selectively movable up and down, said vertical mast;

a horizontal tool tray having a planar bottom surface and supported by a linear tool tray support structure;

said linear tool tray support structure being pivotally connected at one end to said elevator means and releasably attached to said planar bottom surface of said horizontal tool tray at the other end thereof;

said horizontal tool tray being pivotally and horizontally movable relative to said vertical mast to adjust the relative position thereof; and said horizontal tool tray including at least one vertical side extending from said planar bottom surface and at least one removable parts container releasably supported by said at least one vertical side.

13. The positionable service bench of claim 12 including at least one electrical outlet and at least one air chuck disposed on said vertical mast and accessible to a mechanic utilizing said positionable service bench; said at least one electric outlet including means connectible to a source of electrical current and said at least one air chuck including means connectible to a source of pressurized air.

* * * * *